United States Patent [19]

Kurotaka et al.

[11] Patent Number: 4,696,418

[45] Date of Patent: Sep. 29, 1987

[54] DEVELOPER CONTAINER FOR DRY-PROCESS DEVELOPMENT

[75] Inventors: Sigeo Kurotaka, Sagamihara; Moriyosi Tukano, Kawasaki, both of Japan

[73] Assignee: Ricoh Company, Ltd., Tokyo, Japan

[21] Appl. No.: 763,606

[22] Filed: Aug. 8, 1985

[30] Foreign Application Priority Data

Aug. 20, 1984 [JP] Japan ..... 59-173919

[51] Int. Cl.[4] ..... B65D 23/04; B65D 83/06

[52] U.S. Cl. ..... 222/167; 222/325; 222/DIG. 1; 118/612; 206/220; 366/130; 366/187; 366/227

[58] Field of Search ..... 222/DIG. 1, 167, 169, 222/196.1, 196.5, 325; 206/220; 366/130, 187, 227, 220, 342; 118/612

[56] References Cited

U.S. PATENT DOCUMENTS

| | | | |
|---|---|---|---|
| 1,931,087 | 10/1933 | Schwarz et al. | 222/196.5 |
| 2,580,132 | 12/1951 | Seymour | 366/130 |
| 3,339,807 | 9/1967 | Eichorn | 222/DIG. 1 X |
| 3,993,290 | 11/1976 | Kovich | 366/130 |
| 4,155,328 | 5/1979 | Navone | 222/DIG. 1 |
| 4,450,957 | 5/1984 | Cohen | 206/220 |

FOREIGN PATENT DOCUMENTS

| | | | |
|---|---|---|---|
| 218572 | 5/1957 | Australia | 366/130 |

*Primary Examiner*—H. Grant Skaggs
*Assistant Examiner*—Frederick R. Handren
*Attorney, Agent, or Firm*—Oblon, Fisher, Spivak, McClelland, & Maier

[57] ABSTRACT

A toner container for use with a developing unit of an electrostatographic copier or the like which is rotated to discharge a toner thereoutof is disclosed. A toner agitating member is accommodated in the container in a freely movable manner and shaped and dimensioned to be prevented from slipping out of the container through a slot, or toner outlet, of the container.

2 Claims, 4 Drawing Figures

DEVELOPER CONTAINER FOR DRY-PROCESS DEVELOPMENT

BACKGROUND OF THE INVENTION

The present invention relates to a container such as a cartridge for containing a toner which is used as a developer with a dry-process developing unit of an electrostatographic copier or the like.

In a dry-process developing unit, toner supply has customarily been implemented with a disposable toner cartridge which is either box-shaped or cylindrical. The toner cartridge is removably mounted in a predetermined position inside the housing of the developing unit with its opening, or toner outlet, faced downward, so that the toner may drop out of the cartridge by gravity. The problem with such a gravity type toner cartridge is that a part of the toner is left in the cartridge adhered to the inner wall of the cartridge and, therefore, is simply wasted when the cartridge is discarded after use. Another problem is that every time the cartridge is replaced with another, the toner is scattered around to smear various members which surround the developing unit.

To solve the above problems, an agitating device may be disposed in a toner cartridge so that a toner may be entirely fed out of the cartridge, as disclosed in Japanese Unexamined Patent Publication (Kokai) No. 53-46040. This kind of scheme, however, results in a disproportionate cost for a disposable cartridge due to the need for an agitating mechanism and a mechanism for driving the agitating mechanism.

SUMMARY OF THE INVENTION

It is therefore an object of the present invention to provide an improved toner cartridge which is economical and, yet, allows the entire toner to be discharged therefrom.

It is another object of the present invention to provide a generally improved developer container for dry-process development.

A developer container for use with a developing unit of an electrostatographic copier or the like of the present invention comprises a rotatable hollow body which accommodates the developer therein. A slot is formed through a wall of the container body in a lengthwise direction of the body for discharging the developer therethrough. At least one agitating member is freely movably disposed in the container body for agitating the developer and shaped and dimensioned to be prevented from slipping out of the container through a slot, or toner outlet, of the container.

The above and other objects, features and advantages of the present invention will become more apparent from the following detailed description taken with the accompanying drawings.

DESCRIPTION OF THE PREFERRED EMBODIMENTS

While the developer container for dry-process development of the present invention is susceptible of numerous physical embodiments, depending upon the environment and requirements of use, substantial numbers of the herein shown and described embodiments have been made, tested and used, and all have performed in an eminently satisfactory manner.

Figure 1:
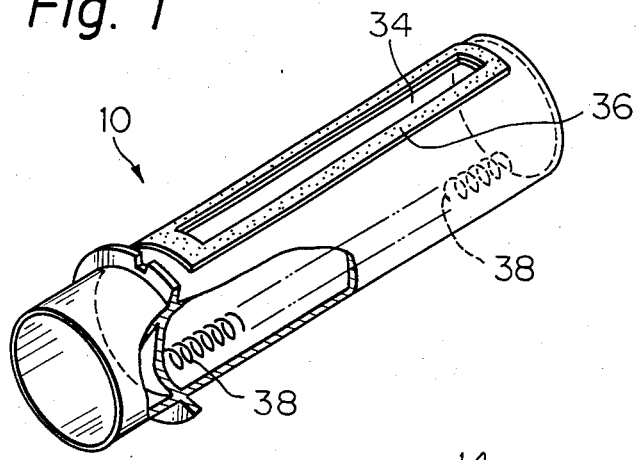
FIG. 1 is a perspective view of a toner cartridge embodying the present invention.
Figure 2:
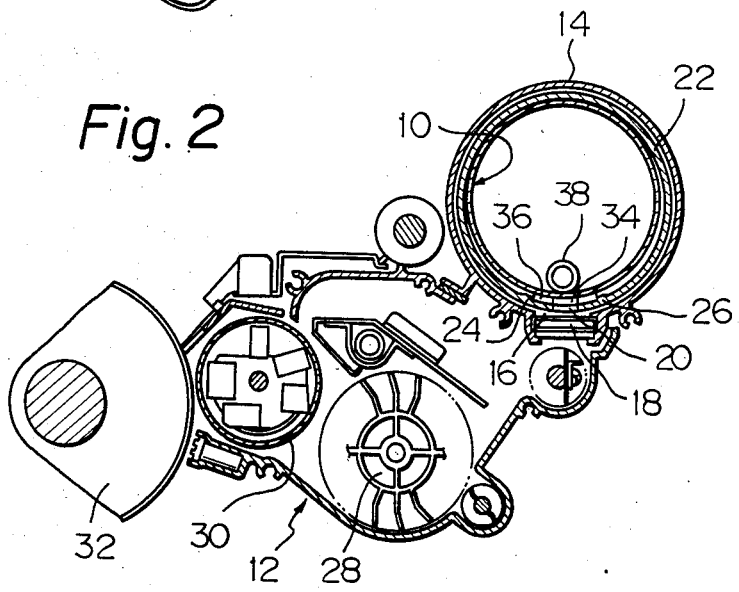
FIG. 2 is a fragmentary section of an electrostatographic copier showing a developing unit which uses the toner cartridge of FIG. 1 and a part of a photoconductive element.

Referring to FIG. 1 of the drawings, a toner cartridge embodying the present invention is shown and generally designated by the reference numeral 10. A developing unit of an electrostatographic copier or the like to which the cartridge 10 is applicable is shown in FIG. 2. The construction of the developing unit, generally 12, will be outlined first.

As shown in FIG. 2, the developing unit 12 includes a cylindrical hopper casing 14 which is adapted to accommodate the toner cartridge 10 therein and provided with an opening 16 in a bottom portion thereof. A shutter 18 is reciprocable in the lengthwise direction of the hopper casing 14 to selectively communicate the opening 16 to the interior of a housing of the developing unit 12. A cartridge casing 22 is provided with an opening 20 along the length thereof and mounted in the hopper casing 14. The cartridge casing 22 is rotatable in driven connection with a drive mechanism, not shown. A pair of parallel ridges 24 and 26 extend on the inner surface of the cartridge casing 22 and at the opposite sides of the opening 20. After the cartridge 10 has been inserted into the cartridge casing 22 through a front open end of the latter, the cartridge casing 22 is rotatable integrally with the cartridge 10 while holding the edges of a slot of the cartridge, which will be described, by means of the ridges 24 and 26. While the cartridge 10 is rotated together with the cartridge casing 22, the toner inside the cartridge 10 is agitated and discharged. The toner flows down into the developing unit 12 is conveyed by an agitator 28 to a developing roller 30 which is rotatable to transport the toner toward the surface of a photoconductive element 32. The toner develops a latent image which has been electrostatically formed on the element 32, thereby providing a toner image. Such a developing process is well known in the art and, therefore, will not be discussed in detail for simplicity.

As shown in detail in FIG. 1, the toner cartridge 10 of the present invention which is mounted in the cartridge casing 22 is provided with a slot, or toner outlet, 34 along the length thereof. A packing 36 is provided on the outer periphery of the cartridge 10 to surround the slot 34 so as to fulfill two different functions, i.e. sealing the gap between the cartridge 10 and the cartridge casing 22 and facilitating positioning which is effected by the ridges 24 and 26. A toner agitating member 38 is disposed in the cartridge 10 in a freely movable manner. In this particular embodiment, the agitating member 38 is implemented by a thin wire configured in an elongate coil which is longer than the slot 34 and the diameter of the cartridge. A plurality of such coils may be accommodated in the cartridge 10, if desired.

The cartridge 10 having the above construction is used as follows. First, a seal (not shown) which covers the slot 34 of a fresh cartridge 10 is removed and, then, the cartridge 10 is inserted into the cartridge casing 22 with the slot 34 faced upward and with the packing 36 aligned with the ridges 24 and 26 of the casing 22. As the copier is operated, the cartridge casing 22 which is operatively connected to an end of a drive shaft (not shown) is driven to rotate together with the cartridge 10. As a result, the agitating member 38 rolls inside the cartridge 10 due to the rotation of the cartridge 10, while agitating the toner which makes contact therewith. As the toner in the cartridge 10 is consumed, the agitating member 38 rolls in contact with the inner wall of the cartridge 10 to scrape the toner off the cartridge and, every time the slot 34 is brought to the bottom, discharges the scraped toner out of the cartridge 10. This part of the toner, like the rest, is fed to the interior of the developing unit 12 through the shutter 18.

Figure 3A:
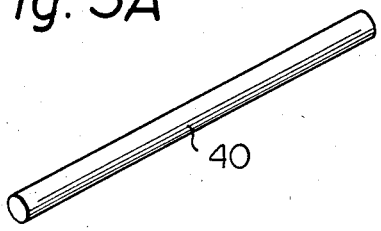
FIGS. 3A and 3B are perspective views of alternative specific configurations of an agitating member which is included in the toner cartridge of FIG. 1.
Figure 3B:
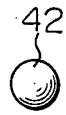

The agitating member 38 may be replaced with any other suitable agitating member 38 such as shown in FIGS. 3A and 3B insofar as the function assigned thereto is fulfilled. In FIG. 3A, an agitating member 40 is shown which is implemented by a rod having a circular, oval or polygonal cross-section. in FIG. 3B, the agitating member comprises one or more masses 42 each having a spherical, star-shaped or polyhedral configuration which is sized large enough to be prevented from slipping out through the slot 34.

In summary, it will be seen that the present invention provides a developer container for dry-process development which suitably agitates a toner accommodated therein, effectively scrapes the toner off the inner periphery of the container as the toner is consumed so as to eliminate waste of toner, and prevents the toner from being scattered around when the container is replaced with another.

Various modifications will become possible for those skilled in the art after receiving the teachings of the present disclosure without departing from the scope thereof.

What is claimed is:

1. A developer container for supplying a dry-process developing unit with a developer, comprising:

a rotatable cylindrical hollow body accommodating the developer therein;

an elongated slot formed through the cylindrical wall of said body in a lengthwise direction of the body for discharging the developer therethrough; and agitating means freely movably disposed in the body for agitating the developer, said agitating means comprising at least one small diameter wire coil having a constant diameter along the length thereof, said coil being dimensioned so as to be prevented from falling out of the container and having a length greater than that of said slot and substantially greater than a diameter of said hollow body, whereby rotation of said hollow body causes rotation of said coil so that said developer is scraped from said wall of said body.

2. A developer container as claimed in claim 1, wherein the developer comprises a toner.

* * * * *